US010670043B2

(12) United States Patent
Lo

(10) Patent No.: US 10,670,043 B2
(45) Date of Patent: Jun. 2, 2020

(54) FOLDING AND UNFOLDING STRUCTURE OF BLADE OF CEILING FAN

(71) Applicant: Po-Kung Lo, Taichung (TW)

(72) Inventor: Po-Kung Lo, Taichung (TW)

( * ) Notice: Subject to any disclaimer, the term of this patent is extended or adjusted under 35 U.S.C. 154(b) by 0 days.

(21) Appl. No.: 15/776,904

(22) PCT Filed: Jun. 27, 2016

(86) PCT No.: PCT/CN2016/000353
§ 371 (c)(1),
(2) Date: May 17, 2018

(87) PCT Pub. No.: WO2018/000106
PCT Pub. Date: Jan. 4, 2018

(65) Prior Publication Data
US 2019/0219063 A1 Jul. 18, 2019

(51) Int. Cl.
*F04D 29/36* (2006.01)
*F04D 25/08* (2006.01)
*F04D 29/38* (2006.01)

(52) U.S. Cl.
CPC ..... *F04D 29/36* (2013.01); *F04D 25/088* (2013.01); *F04D 29/366* (2013.01);
(Continued)

(58) Field of Classification Search
CPC ..... F04D 29/36; F04D 29/362; F04D 29/364; F04D 29/366; F04D 29/38; F04D 29/384;
(Continued)

(56) References Cited

U.S. PATENT DOCUMENTS 6,213,716 B1 * 4/2001 Bucher ..... F04D 25/088 416/142
6,688,850 B2 2/2004 Bucher et al.
(Continued)

FOREIGN PATENT DOCUMENTS

CN ZL200620115610.7 6/2007
CN ZL200720024875.0 7/2008
(Continued)

*Primary Examiner* — Kenneth J Hansen
*Assistant Examiner* — Justin A Pruitt
(74) *Attorney, Agent, or Firm* — Thomas J. Nikolai; DeWitt LLP

(57) ABSTRACT

A folding and unfolding structure of blade of a ceiling fan includes a driving device, a rotary member, multiple connection arms, multiple fixed arms, multiple extension arms, multiple elastic members and multiple blades. The rotary member rotates synchronously with the driving device. One end of the connection arm is connected to the rotary member, and the other end of the connection arm is pivotably connected to one end of an extension arm by a first pivot. One end of the fixed arm is connected to a blade, and the other end of the fixed arm is pivotably connected to the other end of an extension arm by a second pivot. The elastic members are provided between the extension arms and the connection arms to restricting outward expansion of the extension arms, such that the extension arms are pivoted upward about the first pivots and move close to the rotary member.

7 Claims, 6 Drawing Sheets

(52) U.S. Cl.
CPC ..... *F04D 29/384* (2013.01); *F04D 29/388* (2013.01); *F05D 2260/50* (2013.01)

(58) Field of Classification Search
CPC .. F04D 29/388; F04D 25/088; F05D 2260/38; F05D 2260/50; F05D 2250/90; E05D 15/26; E05D 15/262
USPC ..... 416/142, 206; 74/469, 471 R; 16/282, 16/283, 287, 288, 289, 290, 302, 304, 16/305, 306
See application file for complete search history.

(56) References Cited

U.S. PATENT DOCUMENTS

| | | | | |
|---|---|---|---|---|
| 7,520,023 | B2 * | 4/2009 | Hirtsiefer | E05D 3/12 16/282 |
| 8,142,156 | B2 * | 3/2012 | Wiegel | F04D 25/088 169/16 |
| 8,424,160 | B2 * | 4/2013 | Chen | E05D 11/084 16/278 |
| 2011/0158813 | A1 | 6/2011 | Bucher et al. | |
| 2013/0097809 | A1 * | 4/2013 | Weber | E05D 5/00 16/308 |

FOREIGN PATENT DOCUMENTS

| | | | |
|---|---|---|---|
| CN | ZL201220466249.8 | | 4/2013 |
| CN | ZL201620652590.0 | | 12/2016 |
| EP | 102955 | A1 | 5/2000 |
| TW | M244370 | U | 9/2004 |
| TW | M345145 | U1 | 11/2008 |
| TW | M387920 | U1 | 9/2010 |
| TW | M467745 | | 12/2013 |
| TW | M482700 | U | 7/2014 |

* cited by examiner

FOLDING AND UNFOLDING STRUCTURE OF BLADE OF CEILING FAN

BACKGROUND OF THE INVENTION

1. Fields of the Invention

The present invention relates to a ceiling fan, and more particularly, to a folding and unfolding structure of blades of a ceiling fan. The blades are folded when not in operation, and unfolded when in use.

2. Descriptions of Related Art

The conventional ceiling fans are cataloged into fixed type and expanding type. The fixed type means that the blades are fixed to the rotary member and always in expanded status. The expanding type means that the blades are pivotably connected to the rotary member which is connected to the motor. When the ceiling fan is not in use, the blades are folded inward. When the ceiling fan is in operation, the blades unfold outward when the rotary member rotates.

There are two different operational types for the expanding type ceiling fans. The first one is that the blades unfold horizontally relative to the rotary member, and unfold inward. The mechanism for the first one operational type includes a main gear cooperated with planet gears to allow the blades to fold by resilient members, and to unfold due to eccentric force when the rotary member rotates. Taiwan patent number M345145, M387920 and M482700 respectively disclose such types of ceilings.

The second one is that the blades are folded downward when not in use such as those disclosed by Taiwan patent number M244370, and China Patent number ZL 200620115610.7. The blades are pivotably connected to the rotary member by support arms pivotably connected between the blades and the rotary member. When the ceiling fan is not in use, the blades are folded and extend downward and are located around the rotary member. This type is easily to clean up when compared with the first type that the blades may be damaged when being cleaned up. However, when in operation, the support arms pivot up and down so that the motor has to overcome the weight of the blade and the length of the arm of force of the support arms, therefore, the motor bears a heavy load and is easily shank and vibrate.

The present invention intends to provide a folding and unfolding structure for blades of a ceiling fan to eliminate the drawbacks mentioned above.

SUMMARY OF THE INVENTION

The present invention relates to a folding and unfolding structure of blade of a ceiling fan, and comprises a driving device, a rotary member which rotates synchronously with the driving device. Multiple connection arms each have a first end connected to the rotary member, and a second end of each connection arm has a first pivotal portion formed thereto. Multiple fixed arms each have a first end connected to a blade, and a second end of each fixed arm has a second pivotal portion formed thereto. Multiple extension arms each have a first pivotal end and a second pivotal end respectively formed on two ends thereof. The first pivotal end is pivotably connected to the first pivotal portion corresponding thereto by a first pivot. The second pivotal end is pivotably connected to the second pivotal portion corresponding thereto by a second pivot. Multiple elastic members are respectively connected between each first pivotal end and each first pivotal portion to control each extension arm to expand outward. Each elastic member provides a force to the extension arm corresponding thereto so that the extension arms are pivoted upward about the first pivots and move close to the rotary member.

Preferably, each of the connection arms has a protrusion extending from the middle portion thereof and toward a direction away from the connection arm. When each of the extension arms is pivoted and moves close to the rotary member, the protrusion contacts the extension arm to restrict the extension arm from pivoting.

Preferably, the elastic members each are a torsion spring and includes a U-shaped bridge, and two spiral coils respectively extend from two ends of the bridge. Each spiral coil has an insertion. The two insertions are located on two sides of the first pivotal portion. The first pivot extends through the two spiral coils, and the bridge contacts the extension arm.

Preferably, the first pivotal portion of each of the connection arms includes two first lugs and each first lug includes a first bore. The second pivotal portion of each of the fixed arms includes two second lugs and each second lug includes a second bore. The first and second pivotal ends of each of the extension arms respectively include two third lugs and two fourth lugs. Each third lug includes a third bore, and each fourth lug includes a fourth bore. The first pivot extends through the first bores of the first pivotal portion and the third bores of the first pivotal end. The second pivot extends through the second bores of the second pivotal portion and the fourth bores of the second pivotal end so as to connect the connection arm, the extension arm and the fixed arm together.

Preferably, each of the first lugs of each of the first pivotal portions includes multiple positioning holes located around the first bore corresponding thereto. The insertion of each of the two spiral coils is inserted into one of the positioning holes.

Preferably, the first pivots each include a first shank and a groove is defined in the outside of the first shank. A C-clip is engaged with the groove.

Preferably, the second pivots each includes a second shank and outer threads are defined in the outside of the second shank. A nut is threadedly connected to the outer threads of the second shank.

The purposes of the present invention are that the folding and unfolding actions of the blades of the ceiling fan are smooth, and the life of the ceiling fan is prolonged. The ceiling fan has a modern and specific outer appearance to have higher commercial competition.

The advantages of the present invention are that the rotary member is connected to the blades by the connection between the connection arms, the fixed arms and the extension arms, so that the blades unfold outward section by section to improve the problems of shanking and unstable happened on the conventional blades. The blades are located around the rotary member when not in use, and this makes the ceiling fan looks like a flower bud when not in use, and which has specific attraction.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
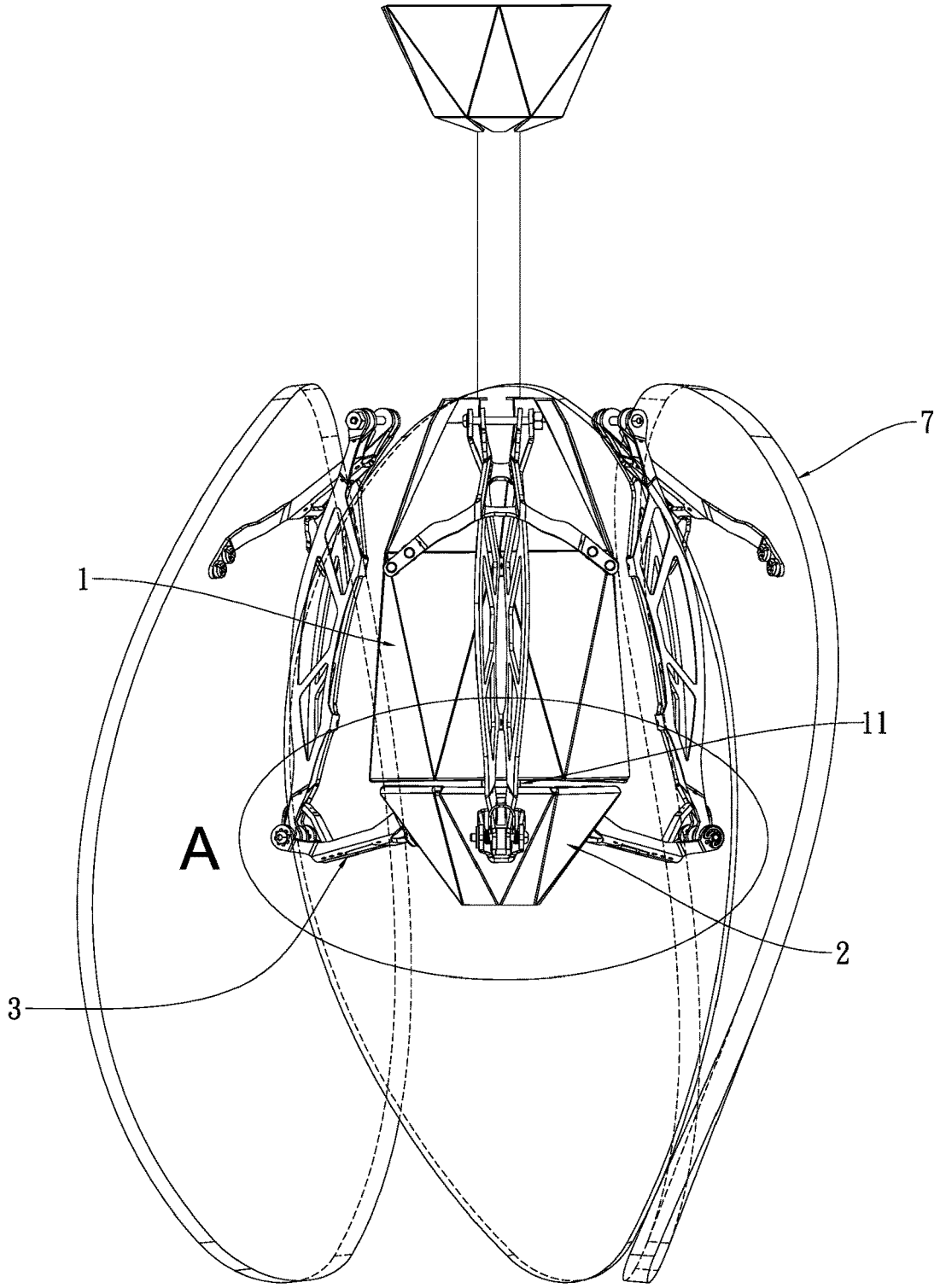
FIG. 1 is a perspective view to show that the blades of the ceiling fan of the present invention are folded.
Figure 2:
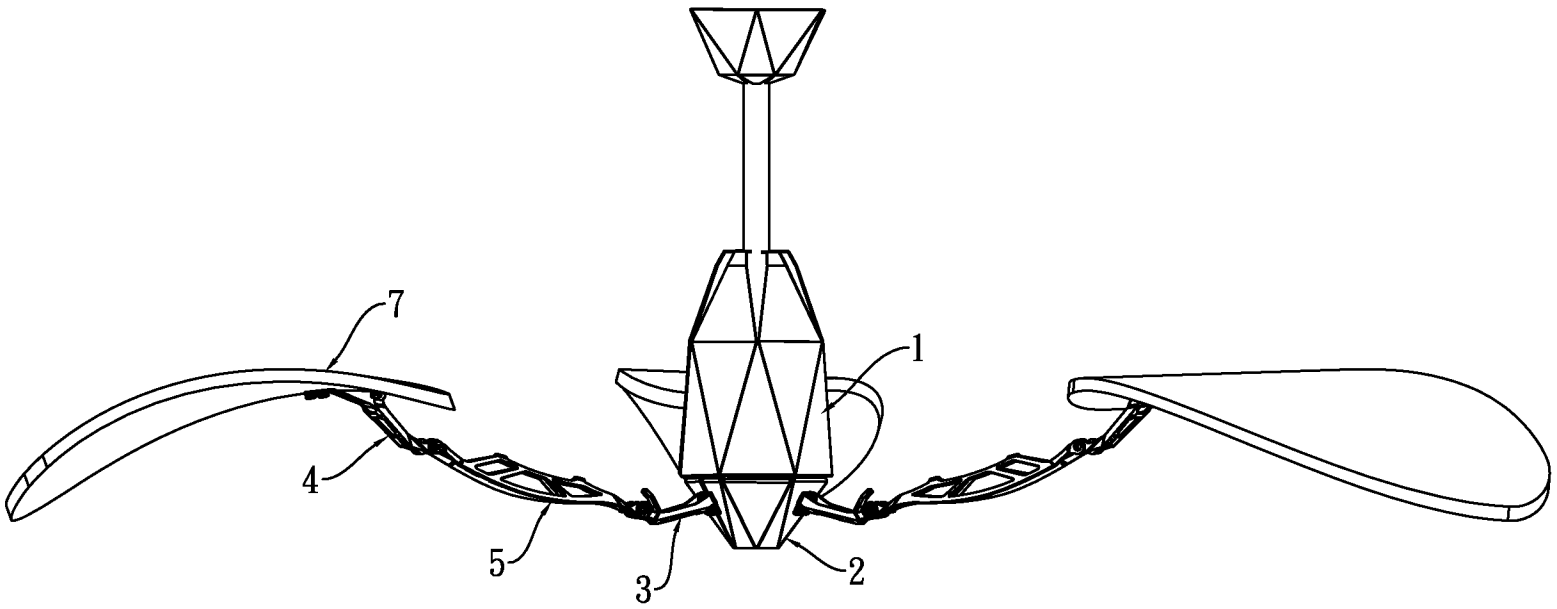
FIG. 2 is a perspective view to show that the blades of the ceiling fan of the present invention are unfolded.

Referring to FIGS. 1 to 7, the folding and unfolding structure of blade of a ceiling fan of the present invention comprises a driving device 1, a rotary member 2, multiple connection arms 3, multiple fixed arms 4, multiple extension arms 5, multiple elastic members 6 and multiple blades 7. The rotary member 2 rotates synchronously with the driving device 1. The connection arms 3 each have a first end connected to the rotary member 2, and a second end of each connection arm 3 has a first pivotal portion 31 formed thereto. The fixed arms 4 each have a first end connected to a blade 7, and a second end of each fixed arm 4 has a second pivotal portion 41 formed thereto. The extension arms 5 each have a first pivotal end 51 and a second pivotal end 52 respectively formed on two ends thereof. The first pivotal end 51 is pivotably connected to the first pivotal portion 31 corresponding thereto by a first pivot 8. The second pivotal end 52 is pivotably connected to the second pivotal portion 41 corresponding thereto by a second pivot 9. The elastic members 6 are respectively connected between each first pivotal end 51 and each first pivotal portion 31 to control each extension arm 5 to expand outward. Each elastic member 6 provides a force to the extension arm 5 corresponding thereto so that the extension arms 5 are pivoted upward about the first pivots 8 and move close to the rotary member 2. The blades 7 are pivotable downward about the second pivots 9 and collected around the rotary member 2.

It is noted that the connection between the connection arms 3 and the rotary member 2 can be threadedly connection by bolts. The connection between the fixed arms 4 and the blades 7 can be threadedly connection by bolts. The driving device 1 is an internal-rotation motor, and the rotary member 2 is connected with the shaft of the motor so that the rotary member 2 rotates synchronously with the motor. The driving device 1 can be an external-rotation motor. The rotary member 2 is a casing of the motor, and the connection arms 3 are connected to the lower portion of the motor casing.

Figure 3:
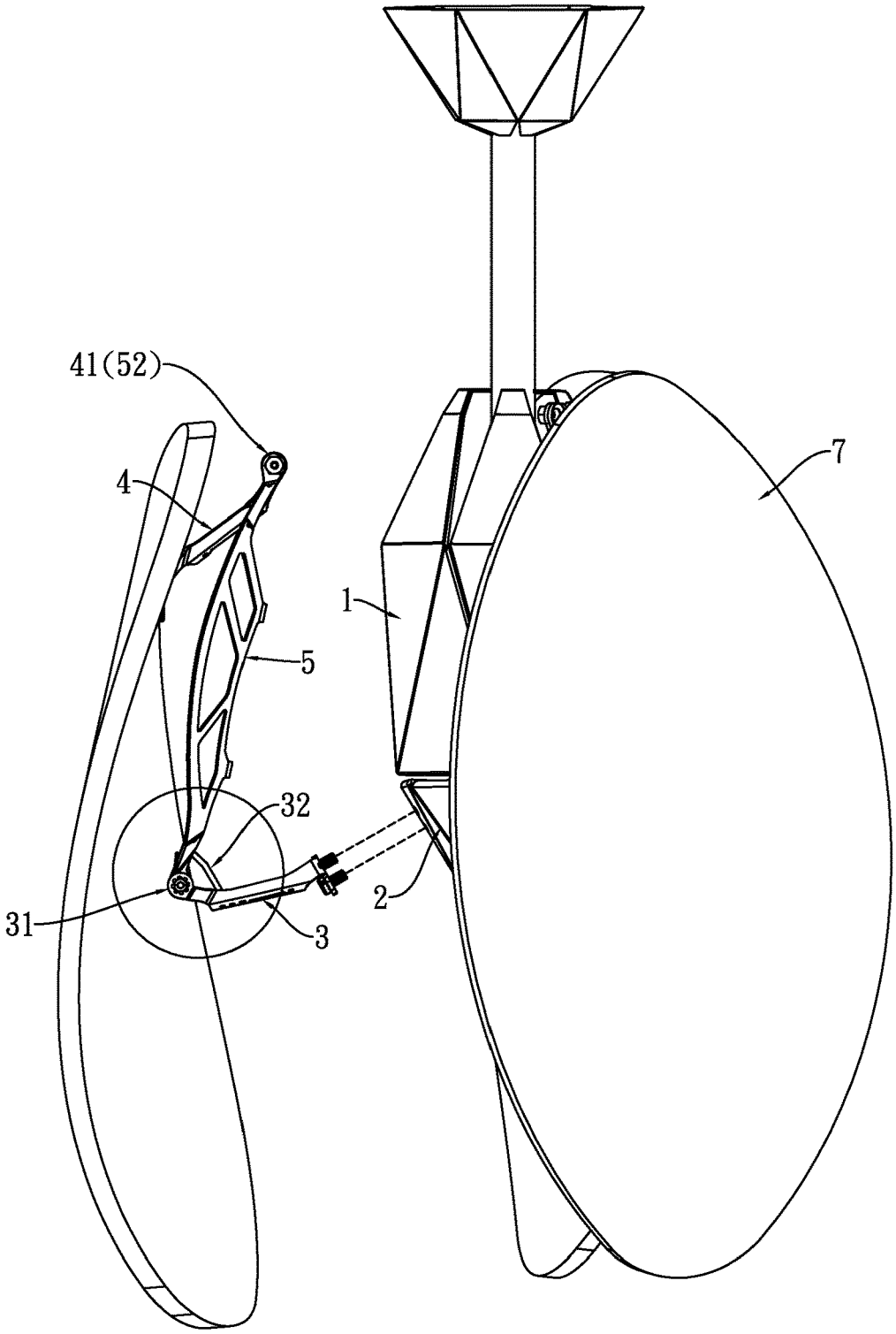
FIG. 3 shows one blade is to be installed to the ceiling fan.
Figure 4:
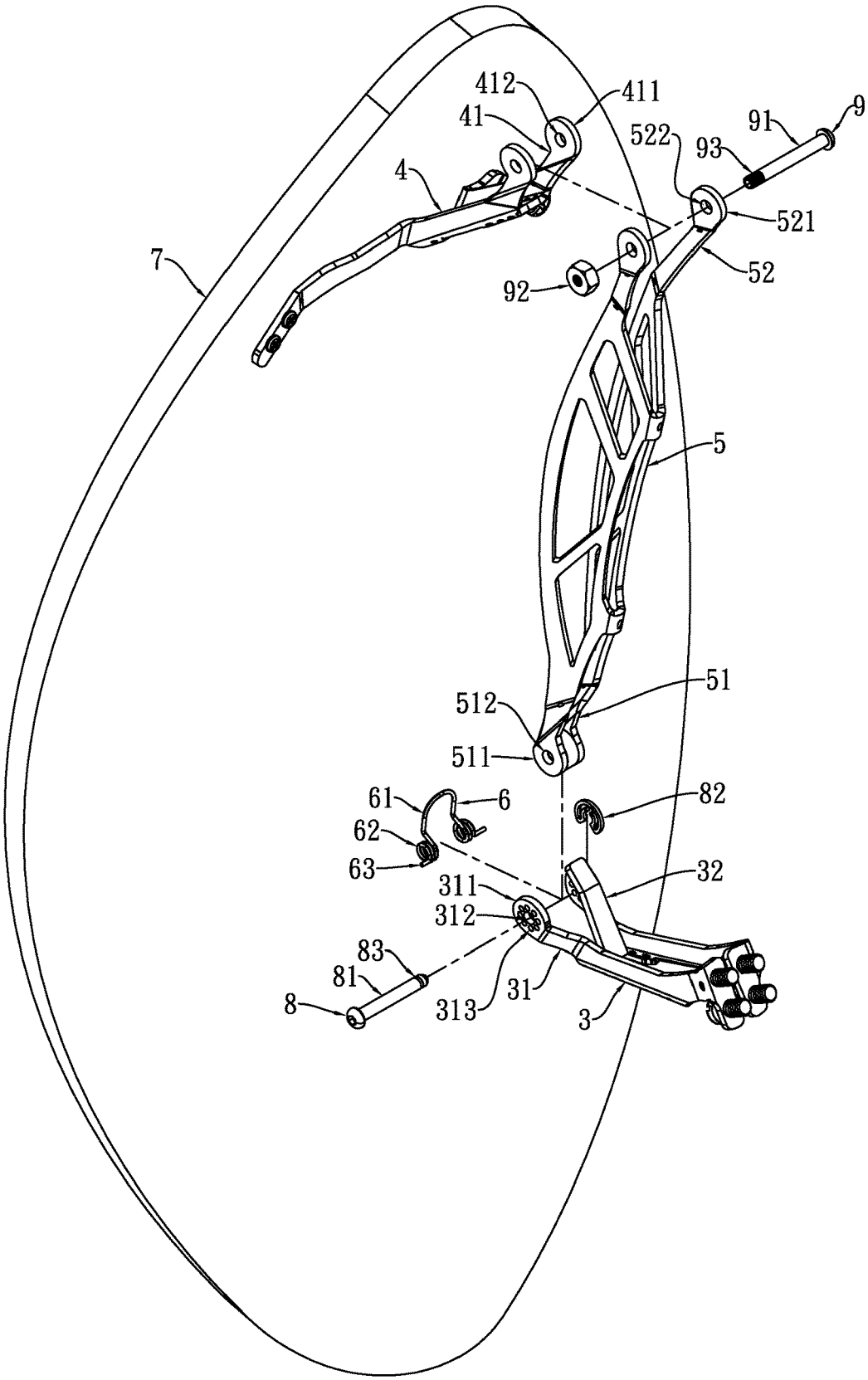
FIG. 4 is an exploded view of one of the blades and the arms of the present invention.
Figure 5:
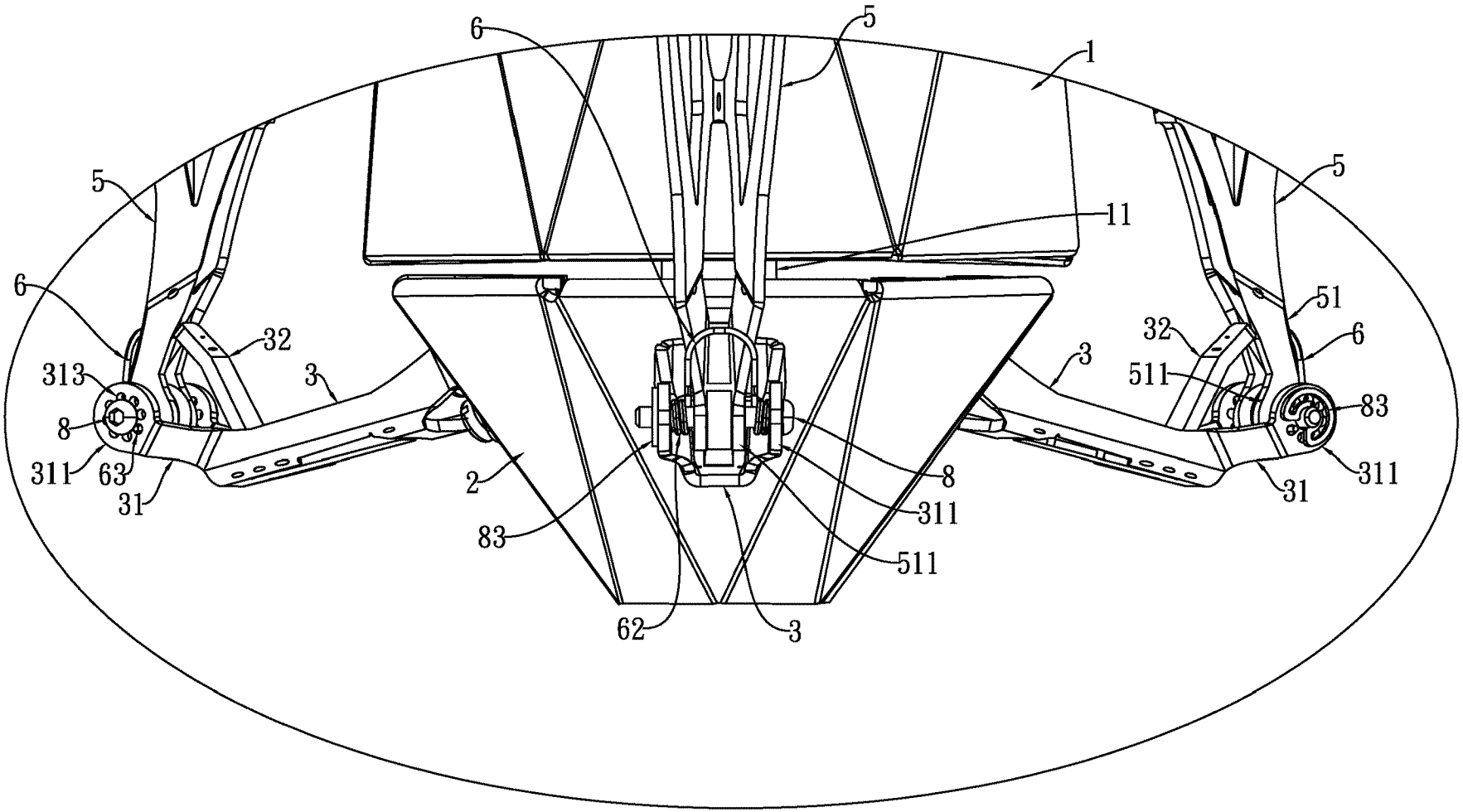
FIG. 5 is an enlarged view of the circled portion "A" in FIG. 1.

As shown in FIGS. 3 to 5, each of the connection arms 3 has a protrusion 32 extending from the middle portion thereof and toward a direction away from the connection arm 3. When each of the extension arms 5 is pivoted and moves close to the rotary member 2, the protrusion 32 contacts the extension arm 5 to restrict the extension arm 5 from pivoting.

The elastic members 6 each are a torsion spring and includes a U-shaped bridge 61 and two spiral coils 62 respectively extend from two ends of the bridge 61. Each spiral coil 62 has an insertion 63, and the two insertions 63 are located on two sides of the first pivotal portion 31. The first pivot 8 extends through the two spiral coils 62, and the bridge 61 contacts the extension arm 5 as shown in FIG. 5.

As shown in FIG. 4, the first pivotal portion 31 of each of the connection arms 3 includes two first lugs 311 and each first lug 311 includes a first bore 312. The second pivotal portion 41 of each of the fixed arms 4 includes two second lugs 411 and each second lug 411 includes a second bore 412. The first pivotal end 51 of each of the extension arms 5 includes two third lugs 511. The second pivotal end 52 of each of the extension arms 5 has two fourth lugs 521. Each third lug 511 includes a third bore 512, and each fourth lug 521 includes a fourth bore 522. The first pivot 8 extends through the first bores 312 of the first pivotal portion 31 and the third bores 512 of the first pivotal end 51, and the second pivot 9 extends through the second bores 412 of the second pivotal portion 41 and the fourth bores 522 of the second pivotal end 52 so as to connect the connection arm 3, the extension arm 5 and the fixed arm 4 together.

Each of the first lugs 311 of each of the first pivotal portions 31 includes multiple positioning holes 313 located around the first bore 312 corresponding thereto. The insertion 63 of each of the two spiral coils 62 is inserted into one of the positioning holes 313.

The first pivots 8 each include a first shank 81 and a groove 83 is defined in the outside of the first shank 81. After the first pivot 8 extends through the first bores 312 and the third bores 512, a C-clip 82 is engaged with the groove 83.

The second pivots 9 each includes a second shank 91 and outer threads 93 are defined in the outside of the second shank 91. After the second pivot 9 extends through the second bores 412 and the fourth bores 522, a nut 92 is threadedly connected to the outer threads 93 of the second shank 91.

Figure 6:
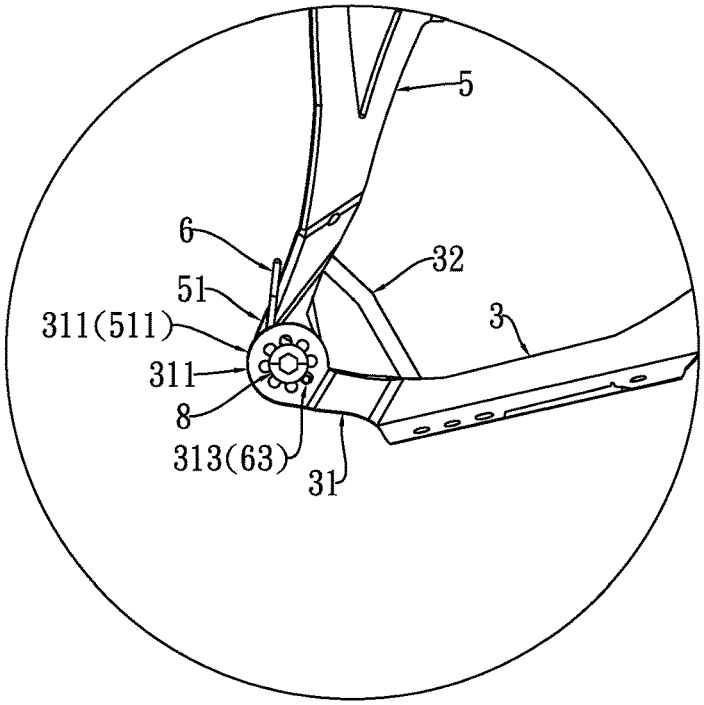
FIG. 6 is an enlarged view to show the connection arm and the extension arm of the folded blade.
Figure 7:
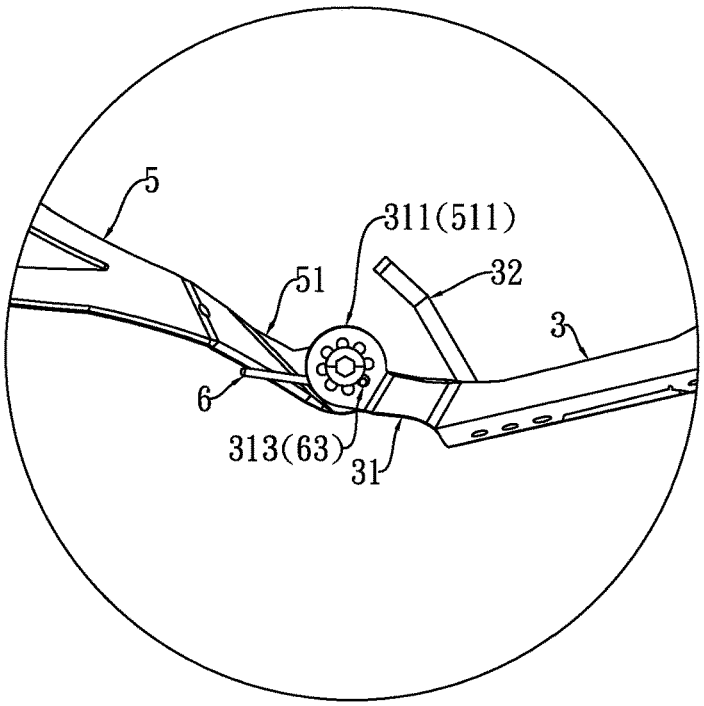
FIG. 7 is an enlarged view to show the connection arm and the extension arm of the unfolded blade.

When the driving device 1 is not in operation, as shown in FIGS. 1 and 3, the rotary member 2 does not rotate about the shaft 11 of the driving device 1. The weight of the blade 7 makes the second pivotal portion 41 of the fixed arm 4 pivot downward about the second pivot 9, and the first pivotal end 51 of the extension arm 5 pivots about the first pivot 8 to arrange the extension arm 5 to be orientated upward and the second pivotal end 52 of the extension arm 5 is located close to the rotary member 2. The blade 7 is oriented downward and located close to the rotary member 2. This position of the blade 7 is easily cleaned up by the users without worry of being damaged as seen for the conventional ceiling fans. When the extension arm 5 is pivoted toward the rotary member 2, the protrusion 32 of the connection arm 3 contacts the extension arm 5 to restrict the extension arm 5 from pivoting to hit the rotary member 2 and the driving device 1 as shown in FIGS. 5 and 6. When the driving device 1 is activated and the rotary member 2 rotates, the blade 7 is pivoted upward by the pivotal movement of the fixed arm 4 about the second pivot 9 due to the eccentric force. The extension arm 5 overcomes the force from the elastic member 6, and the second pivotal end 52 of the extension arm 5 pivots downward so that the second pivotal end 52 of the extension arm 5 moves in the direction away from the rotary member 2. That is to say, the blades 7 each expand outward relative to the center of the ceiling fan, and the rotation of the blades 7 generates air flow. The rotary member 2 is connected to the blades 7 by the connection between the connection arms 3, the fixed arms 4 and the extension arms 5, so that when the rotary member 2 rotates, the blades 7 unfold outward section by section smoothly. The present invention improves the problems of shanking and unstable happened on the conventional blades. The present invention prolongs the life of the ceiling fan. The ceiling fan of the present invention meets the aesthetic purposes and is novel and modern, either in the folded or unfolded status.

While we have shown and described the embodiment in accordance with the present invention, it should be clear to those skilled in the art that further embodiments may be made without departing from the scope of the present invention.

What is claimed is:

1. A folding and unfolding structure of a blade of a ceiling fan, comprising:

a driving device;

a rotary member rotating synchronously with the driving device;

multiple blades with each blade being connected to the rotary member by:

a connection arm having a first end connected to the rotary member and a second end having a first pivotal portion formed thereto;

a fixed arm having a first end connected to the blade and a second end having a second pivotal portion formed thereto;

an extension arm having a first pivotal end and a second pivotal end respectively formed on two ends thereof, the first pivotal end pivotably connected to the first pivotal portion by a first pivot, the second pivotal end pivotably connected to the second pivotal portion by a second pivot, and an elastic member connected between the first pivotal end and the first pivotal portion to control the extension arm to expand outward, the elastic member providing a force to the extension arm so that the extension arm is pivoted upward about the first pivot and moves closer to the rotary member.

2. The folding and unfolding structure of a blade of a ceiling fan as claimed in claim 1, wherein the connection arm has a protrusion extending from a middle portion thereof and toward a direction away from the connection arm, when the extension arm is pivoted and moves close to the rotary member, the protrusion contacts the extension arm to restrict the extension arm from pivoting.

3. The folding and unfolding structure of a blade of a ceiling fan as claimed in claim 2, wherein the elastic member is a torsion spring and includes a U-shaped bridge and two spiral coils respectively extend from two ends of the bridge, each spiral coil has an insertion, the two insertions are located on two sides of the first pivotal portion, the first pivot extends through the two spiral coils, the bridge contacts the extension arm.

4. The folding and unfolding structure of a blade of a ceiling fan as claimed in claim 1, wherein the first pivotal portion of the connection arm includes two first lugs and each first lug includes a first bore, the second pivotal portion of the fixed arm includes two second lugs and each second lug includes a second bore, the first and second pivotal ends of the extension arm respectively include two third lugs and two fourth lugs, each third lug includes a third bore, each fourth lug includes a fourth bore, the first pivot extends through the first bores of the first pivotal portion and the third bores of the first pivotal end, and the second pivot extends through the second bores of the second pivotal portion and the fourth bores of the second pivotal end so as to connect the connection arm, the extension arm and the fixed arm together.

5. The folding and unfolding structure of a blade of a ceiling fan as claimed in claim 4, wherein each of the first lugs of the first pivotal portion includes multiple positioning holes located around the first bore corresponding thereto, the insertion of each of the two spiral coils is inserted into one of the positioning holes.

6. The folding and unfolding structure of a blade of a ceiling fan as claimed in claim 1, wherein the first pivot includes a first shank and a groove is defined in an outside of the shank, a C-clip is engaged with the groove.

7. The folding and unfolding structure of a blade of a ceiling fan as claimed in claim 1, wherein the second pivot includes a second shank and outer threads are defined in an outside of the second shank, a nut is threadedly connected to the outer threads of the second shank.

* * * * *